United States Patent [19]

Blommerde et al.

[11] 3,983,439

[45] Sept. 28, 1976

[54] MERCURY VAPOR DISCHARGE LAMP WITH MERCURY CONTAINER IN ENVELOPE EXHAUST TUBE

[75] Inventors: Cornelis Wilhelmus Adrianus Blommerde; Johannes Antonius Maria Ridders, both of Eindhoven; Huibregt Westerbeke, Middelburg, all of Netherlands

[73] Assignee: U.S. Philips Corporation, New York, N.Y.

[22] Filed: Mar. 20, 1975

[21] Appl. No.: 560,166

[30] Foreign Application Priority Data

Feb. 12, 1975 Netherlands ..... 7501631

[52] U.S. Cl. ..... 313/174; 313/177; 313/220

[51] Int. Cl.[2] ..... H01J 61/20; H01J 61/28; H01J 61/30

[58] Field of Search ..... 313/177, 490, 493, 174, 313/220

[56] References Cited

UNITED STATES PATENTS

| | | | |
|---|---|---|---|
| 2,640,945 | 6/1953 | Harbaugh et al. | 313/177 |
| 3,688,148 | 8/1972 | Fedorenko et al. | 313/490 |

*Primary Examiner*—Palmer C. Demeo
*Attorney, Agent, or Firm*—Frank R. Trifari

[57] ABSTRACT

A mercury vapor discharge lamp in which a plate-shaped container is present in the exhaust tube, the container is held in its place in the exhaust tube by a constriction in the container which cooperates with an indentation in the exhaust tube.

6 Claims, 4 Drawing Figures

MERCURY VAPOR DISCHARGE LAMP WITH MERCURY CONTAINER IN ENVELOPE EXHAUST TUBE

The invention relates to a mercury vapour discharge lamp having a lamp envelope and an exhaust tube manufactured according to a method in which is used a closed metal container in which the quantity of mercury in a metallic form necessary for the operation of the lamp is present, which container is plate-shaped and is arranged in the exhaust tube in such manner that the normal pumping operation is not impeded, and which container is heated, after pumping the lamp, to such a temperature that it has opened due to the mercury vapour pressure building up in it.

Such a lamp is described in the Netherlands patent application No. 7,403,804.

In a particular embodiment of the invention in the said patent application, a container is used which is plate-shaped for the greater part and which extends preferably in the longitudinal direction of the exhaust tube so that the resistance to flow in the exhaust tube is increased as little as possible.

A mercury vapour discharge lamp according to the invention is characterized in that the container in the exhaust tube is held in its place by a constriction in the container and an identation in the exhaust tube corresponding thereto. The container then has approximately the shape in cross-section of the numeral eight.

So both during transport and during and after the pumping process the container in which the metallic mercury is present will remain in its place in the exhaust tube. In addition, with these shapes of the container, too intimate a contact between the container and the wall can be avoided; as a result of this, the container can expand freely upon being heated, so that fracture in the glass of the exhaust tube is prevented.

It is to be noted that in a particular embodiment of the above-mentioned Netherlands patent application the container is maintained in its place in that it is present between identation in the exhaust tube. This embodiment has the drawback that the exhaust tube is to be subjected to an extra treatment to provide the second identation. Moreover, the manufacture is hampered in that said identation can be provided only after the container has been placed in the exhaust tube.

The invention will now be described in greater detail with reference to a drawing of a number of embodiments.

Figure 1:
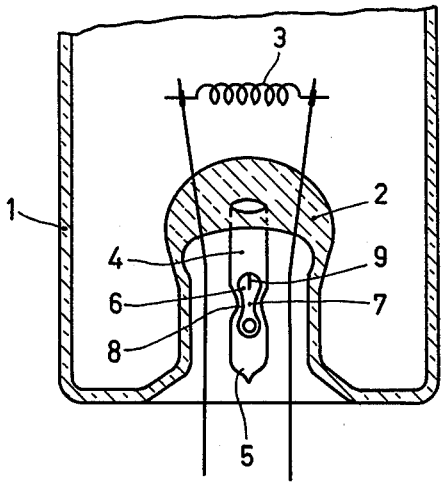
FIG. 1 is a sectional view of the end of a lamp, in which a plate-shaped container which has the shape of an eight is present in the exhaust tube.

Referring now to FIG. 1, reference numeral 1 denotes the tube wall of a low pressure mercury vapour discharge lamp which has at its end a mount 2 comprising an electrode 3. 4 Denotes the exhaust tube which terminates in an aperture in the pinch of the mount 2. Said exhaust tube is sealed at its end 5 after the lamp has been pumped. The plate-shaped container 6 with the mercury is present in the exhaust tube. The container has a constriction 7 so that it obtains the shape of an eight. The identation in the exhaust tube which is provided so as to cooperate with the constriction of the container is denoted by 8. The container also has an incision over the longitudinal axis 9, as a result of which it can more easily pass the identation 8 upon being inserted into the exhaust tube. Moreover, a larger tolerance in the dimensions of the indentation 8 can be permitted.

Figure 2:
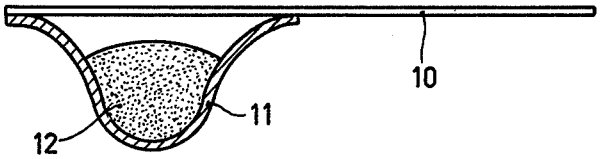
FIG. 2 is a longitudinal sectional view of a container as shown in FIG. 1.

FIG. 2 is a sectional view of the container shown in FIG. 1. The container consists of a flat plate 10 having a cup 11, containing the mercury 12, welded thereon. The plate 10 consists, for example, of an iron-nickel alloy; the cup 11 consists, for example, of iron.

Figure 3:
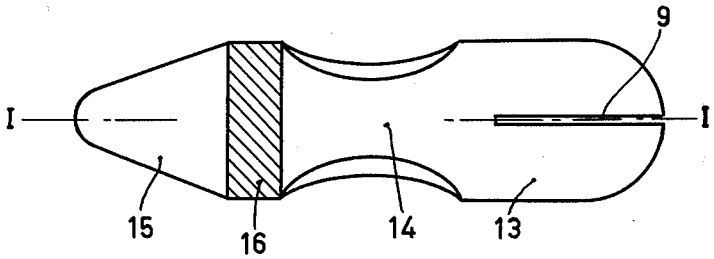
FIG. 3 is an elevation of a container formed from a tube which has been squeezed over part of its length to form the plate-shaped part.

FIG. 3 shows another embodiment of a plate-shaped container. Starting material in this construction is a deep-drawn metal tube, for example, of iron, in which a drop of mercury has been provided, after which the open side of the tube is squeezed up to the mercury, so that the flat part 13 is formed. The constriction 14 is provided in this part 13 by folding. In order to seal the mercury which is now present in the reservoir 15 in a vacuum-tight manner, the squeezed part is provided with a seam weld 16 over a given width. This container, too, has an incision 9 over its longitudinal axis.

Figure 4:
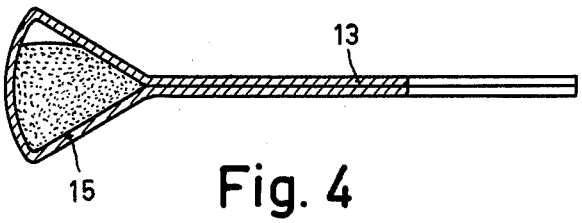
FIG. 4 is a longitudinal sectional view taken on the line I—I of a container as shown in FIG. 3.

FIG. 4 is a cross-sectional view taken on the line I—I of a container shown in FIG. 3, in which 13 denotes the squeezed part and the mercury drop is present in the reservoir 15.

What is claimed is:

1. A mercury vapour discharge lamp which comprises a lamp envelope and an exhaust tube in fluid communication with the interior of said envelope, said exhaust tube including a closed metal container in which a quantity of mercury in a metallic form is disposed in a reservoir section, said container being at least plate-shaped for a portion thereof and dimensioned and configured to allow fluid flow within said tube, said container having a constriction at one axial location, and said exhaust tube having a constriction at one axial location, said constrictions cooperating to constrain movement of said container with respect to said exhaust tube.

2. A mercury vapour discharge lamp as claimed in claim 1 wherein said container has the general shape of the numeral eight.

3. A mercury vapour discharge lamp as claimed in claim 1 wherein said constriction is disposed in the portion of said container which is plate-shaped.

4. A mercury vapour discharge lamp as claimed in claim 3 wherein said portion further includes an incision in the longitudinal direction.

5. A mercury vapour discharge lamp as claimed in claim 3 wherein said container consists of a tube which is squeezed over that part of the length thereof which is outside said reservoir.

6. A mercury vapour discharge lamp as claimed in claim 5 wherein said container has a weld intermediate said reservoir and the squeezed part.

* * * * *

UNITED STATES PATENT AND TRADEMARK OFFICE

CERTIFICATE OF CORRECTION

PATENT NO. : 3983439
DATED : September 28, 1976
INVENTOR(S) : Cornelis W. A. Blommerde et al It is certified that error appears in the above-identified patent and that said Letters Patent are hereby corrected as shown below:

Column 1, line 28
"identation" should be --indentation--

Column 1, line 42
"identation" should be --indentation--

Signed and Sealed this

Twenty-first Day of December 1976

[SEAL]

*Attest:*

RUTH C. MASON
*Attesting Officer*

C. MARSHALL DANN
*Commissioner of Patents and Trademarks*